US010582771B2

(12) United States Patent
Xu et al.

(10) Patent No.: US 10,582,771 B2
(45) Date of Patent: Mar. 10, 2020

(54) SYNCHRONIC DRAWER SLIDE RAIL SYSTEM WITH MUTE SPRINGBACK FUNCTION

(71) Applicant: WUXI HAIDAER PRECISION SLIDES CO., LTD, Wuxi, Jiangsu (CN)

(72) Inventors: Xinglong Xu, Jiangsu (CN); Haiwen Zhang, Jiangsu (CN); Guangda Zhu, Jiangsu (CN); Qiang Ji, Jiangsu (CN)

(73) Assignee: WUXI HAIDAER PRECISION SLIDES CO., LTD, Wuxi, Jiangsu (CN)

( * ) Notice: Subject to any disclaimer, the term of this patent is extended or adjusted under 35 U.S.C. 154(b) by 0 days.

(21) Appl. No.: 15/774,586

(22) PCT Filed: Aug. 26, 2016

(86) PCT No.: PCT/CN2016/096870
§ 371 (c)(1),
(2) Date: May 8, 2018

(87) PCT Pub. No.: WO2017/219487
PCT Pub. Date: Dec. 28, 2017

(65) Prior Publication Data

US 2018/0317653 A1 Nov. 8, 2018

(30) Foreign Application Priority Data

Jun. 24, 2016 (CN) ..... 2016 1 0468119

(51) Int. Cl.
*A47B 88/40* (2017.01)
*A47B 88/497* (2017.01)
(Continued)

(52) U.S. Cl.
CPC ..... *A47B 88/497* (2017.01); *A47B 88/467* (2017.01); *A47B 88/477* (2017.01);
(Continued)

(58) Field of Classification Search
CPC ..... A47B 88/40; A47B 88/44; A47B 88/467; A47B 88/477; A47B 88/493; A47B 88/497
(Continued)

(56) References Cited

U.S. PATENT DOCUMENTS 4,324,439 A * 4/1982 Hagen ..... A47B 88/493 312/331
2006/0250059 A1* 11/2006 Lemm ..... A47B 88/467 312/331
(Continued)

FOREIGN PATENT DOCUMENTS

CN 101221008 A 7/2008

*Primary Examiner* — James O Hansen

(57) ABSTRACT

A synchronic drawer slide rail system with a mute springback function includes: two slide rail units, wherein two external faces of a drawer are connected to two internal faces of a cabinet in a relative sliding form through the slide rail units which are symmetrically arranged; the two slide rail units are synchronically connected to each other through a synchronizing mechanism; wherein a shell unit is fixed on each of the two internal faces of the cabinet; a linear groove extending along a relative sliding direction of the drawer and the cabinet is provided on a side face, which faces the drawer, of the shell unit; each of the slide rail units is installed in the linear groove; a horizontal board extending towards the drawer is arranged at a bottom face of the shell unit, and a rack is provided on an inner end of the horizontal board.

12 Claims, 25 Drawing Sheets

(51) Int. Cl.
*A47B 88/493* (2017.01)
*A47B 88/467* (2017.01)
*A47B 88/477* (2017.01)

(52) U.S. Cl.
CPC ..... *A47B 88/493* (2017.01); *A47B 2210/007* (2013.01); *A47B 2210/0075* (2013.01); *A47B 2210/0078* (2013.01)

(58) Field of Classification Search
USPC ..... 312/319.1, 330.1, 331, 334.1, 334.7, 312/334.8
See application file for complete search history.

(56) References Cited

U.S. PATENT DOCUMENTS

2009/0261698 A1* 10/2009 Cabal Velarde ..... A47B 88/43 312/334.8
2010/0219727 A1* 9/2010 Aguilar Ante ..... A47B 88/46 312/319.1
2012/0038255 A1* 2/2012 Netzer ..... E05B 65/46 312/319.1
2012/0243810 A1* 9/2012 Schwartzmann ..... A47B 88/49 384/20
2013/0249367 A1* 9/2013 Chen ..... F16D 1/02 312/334.8
2014/0202273 A1* 7/2014 Moody ..... F25D 25/025 74/422

* cited by examiner

SYNCHRONIC DRAWER SLIDE RAIL SYSTEM WITH MUTE SPRINGBACK FUNCTION

CROSS REFERENCE OF RELATED APPLICATION

This is a U.S. National Stage under 35 U.S.C. 371 of the International Application PCT/CN2016/096870, filed Aug. 26, 2016, which claims priority under 35 U.S.C. 119(a-d) to CN 201610468119.0, filed Jun. 24, 2016.

BACKGROUND OF THE PRESENT INVENTION

Field of Invention

The present invention relates to a technical field of slide rail system, and more particularly to a synchronic drawer slider rail system with a mute springback function.

Description of Related Arts

The conventional drawer slide rail system usually uses an automatic springback mechanism installed in the slide rail for automatically buffering a last end during closing the drawer, so as to reliably close the drawer. The conventional automatic springback mechanism comprises two species: the first one is driven only by a springback force of the spring to automatically close the drawer slide rail, wherein the buffering effect of the automatic closing is unstable while the noise is large; the second one automatically closes the drawer with cooperation of the spring and the damping device, wherein the damping device can ensure that the drawer slide rail slowly and automatically closes under the springback action, keeping the stable buffering effect in the process of automatic closing, and greatly reducing the noise. However, conventionally, the damping device in such an automatic springback mechanism is mostly installed inside the slide rail, so a large installation space needs to be reserved inside the slide rail, resulting in a large space occupation rate of the entire slide rail assembly. In particular, since the damping device is mostly disposed at the rear end of the outer rail of the slide rail, the rear end of the outer rail needs to provide a considerable space for the damping device. Therefore, a length of the middle rail of the slide rail must be shortened, which means the overlap length of the middle rail and the outer rail is short and the overall carrying capacity of the slide rail is greatly reduced under the same extension length of the slide rail, so it is impossible to meet the bearing requirements of the large drawers.

SUMMARY OF THE PRESENT INVENTION

For overcoming the above problems, an object of the present invention is to provide a synchronic drawer slider rail system with a mute springback function, which can solve problems of a large occupation rate and a low carrying capacity due to a damping device of a springback mechanism of a drawer slider rail system is placed at a bottom end inside a slide rail.

Accordingly, in order to accomplish the above object, the present invention provides a synchronic drawer slide rail system with a mute springback function, comprising: two slide rail units, wherein two external faces of a drawer are connected to two internal faces of a cabinet in a relative sliding form through the slide rail units which are symmetrically arranged; the two slide rail units are synchronically connected to each other through a synchronizing mechanism; wherein each of the slide rail units comprises an outer rail, a middle rail and an inner rail; the outer rail is connected to the inner rail through the middle rail in a sliding form, and the inner rail is fixed on one of the internal faces of the cabinet; wherein a shell unit is fixed on each of the two internal faces of the cabinet; a linear groove extending along a relative sliding direction of the drawer and the cabinet is provided on a side face, which faces the drawer, of the shell unit; each of the slide rail units is installed in the linear groove; a horizontal board extending towards the drawer is arranged at a bottom face of the shell unit, and a rack is provided on an inner end of the horizontal board; a down-facing groove is formed between a bottom groove wall of the linear groove and the rack, and a slide rail springback mechanism is installed in the down-facing groove.

Preferably, a rear end positioning board is arranged at a rear end of the linear groove of the shell unit, two side face positioning boards are arranged on an upper side groove wall and a lower side groove wall of the down-facing groove respectively and extend oppositely; the outer rail of each of the slide rail units is stuck in the linear groove, and the inner rail faces a side face of the drawer; a square through hole is drilled on the outer rail; an elastic hook is correspondingly provided at a bottom of the linear groove of the shell unit, and the elastic hook is engaged with the square through hole; the out rail is limited by the rear end positioning board, the side face positioning boards and the elastic hook.

Preferably, a riveting round hole is drilled on the outer rail of each of the slide rail units; an avoid hole is drilled on the shell unit at a position corresponding to the riveting round hole; the outer rail of each of the slide rail units is riveted with the shell unit by a stainless steel positioning rivet passing through the riveting round hole and the avoid hole; the stainless steel positioning rivet extends out of an external face of the shell unit and cooperates with an installing hole on each of the internal faces of the cabinet for positioning.

Preferably, two positioning poles are arranged on an external face of the shell unit, which cooperates with an installing hole on each of the internal faces of the cabinet for positioning.

Preferably, the slide rail springback mechanism comprises a springback body, a slider, a toggle, a damping device and a spring; the springback body is mounted on the down-facing groove, the toggle is mounted on an internal wall of the inner rail, and a guiding structure is provided on the springback body; the damping device and a rear end of the spring are mounted on the springback body, and the damping device is parallel to the spring; a front end of a damping rod of the damping device and a front end of the spring are respectively connected to the slider; the slider is installed on and movable along the guiding structure; the toggle cooperates with the slider to move the slider along the guiding structure.

Preferably, the springback body is hollowed along a length direction to form a containing groove with an opened external side and form an oblique face part; a front end of the containing groove is sealed, and a rear end of the containing groove has a clamping groove; the spring is placed in the containing groove, and the rear end of the spring is clamped in the clamping groove; a damping device fixing structure is provided on a top wall of the containing groove; a portion of the top wall of the containing groove, which is in front of the damping device fixing structure, forms a horizontal guiding part; the slider is placed on the horizontal guiding part; a rear top portion of the slider is fixed with the guiding rod of the damping device, and a rear bottom portion of the slider is fixed with the front end of the spring; the oblique face part extending downwards is integrally provided in front of the containing groove; a convex is provided on the oblique face part, which forms a positioning groove with a front top corner of the containing groove; an L-shaped limit installing part is provided at a front end of the oblique face part; the horizontal guiding part, the oblique face part, the positioning groove and the L-shaped limit installing part form the guiding structure; an integrated board is provided at the horizontal guiding part and an external face of the oblique face part of the springback body.

Preferably, the slider comprises an internal face board; an upper convex part and a lower convex part are provided on an external side of the internal face board; the lower convex part is placed at a bottom rear end of the internal face board, and a top face of the lower convex part is a horizontal face; a toggle groove with an up-facing opening is provided at a top portion of the upper convex part; a cutting edge, which is obliquely upward, is provided on a bottom face of the upper convex part directly facing the lower convex part; a positioning convex facing downwards is provided on a bottom face of the upper convex part; a concave opening with upward concave is formed between the cutting edge and the positioning convex; a bottom face of the positioning convex is aligned with a rear bottom edge of the upper convex part; a horizontal guiding groove is formed by the positioning convex of the upper convex, the rear bottom edge and the top face of the lower convex part; the horizontal guiding part of the springback body is embedded in the horizontal guiding groove; a bottom edge of the internal face board comprises a front oblique edge and a rear horizontal edge connected with each other; the front oblique edge is obliquely upward and forward, and is parallel to the cutting edge; the positioning convex and the front oblique edge respectively cooperate with the positioning groove and the oblique face part of the springback body.

Preferably, the damping device fixing structure comprises a rear frame and a front frame; a rear end of the damping device is mounted on the rear frame, and a front end of the damping device is limited by the front frame; a horizontal through slot is drilled on the front frame, and the guiding rod of the damping device is connected to a rear end of the slider by passing through the horizontal through slot.

Preferably, a T-shaped groove is provided on the upper convex part and a rear end of the lower convex part; a front end of the guiding rod of the damping device is embedded in the T-shaped groove of the upper convex part, and the front end of the spring is embedded in the T-shaped groove of the lower convex part.

Preferably, the synchronizing mechanism comprises two gears, the rack on each of the slide rail units and a connecting rod; the two gears are respectively installed on the inner rail of corresponding slide rail units by gear holders; the rack on the shell unit of each of the slide rail units is respectively engaged with one of the gears, and the two gears are synchronically connected by the connecting rod.

Preferably, each of the gear holders comprises two semicircular holders oppositely arranged; internal sides of the two semicircular holders are fixed with a circular convex board having a central axis hole; two elastic hooks are symmetrically arranged on internal faces of the semicircular holders, which have symmetric semi-cylindrical grooves; a bridge part extending inwards is provided on the internal wall of the inner rail of each of the slide rail units, and an installing hole is drilled on the bridge part; the two elastic hooks of the gear holders are engaged with the installing hole.

Preferably, each of the gear holders comprises a holder body having an axial through hole; a circular convex board extending out of a circumference of the holder body is placed on an internal face of the holder body, and a positioning board is mounted on an external face of the holder body; a through hole communicating with the axial through hole is drilled at centers of the circular convex board and the positioning board respectively; a positioning flange is provided at two sides of the through hole on an external face of the positioning board respectively; a positioning hole is drilled on the inner rail of each of the slide rail units corresponding to the positioning flange and the through hole; the positioning flange is embedded in the positioning hole of the inner rail, and a rivet passes through the through hole of the circular convex board, the axial through hole of the holder body, the through hole of the positioning board and a middle positioning hole of the inner rail in sequence, so as to rivet the gear holders with the inner rail of each of the slide rail units.

Preferably, an external side of each of the gears has a concave chamber; a central shaft is provided at a bottom center of the concave chamber; clamping hooks are evenly arranged around the central shaft; a convex point is provided at a bottom face of the concave chamber between adjacent clamping hooks; the circular convex board of each of the gear holders extends into the concave chamber of each of the gears while the central shaft extends into the central axis hole, and the clamping hooks are engaged with a circumference of the circular convex board.

Preferably, a square sleeve is provided at an internal face center of each of the gears; T-shaped clamp boards are symmetrically arranged at two sides of the square sleeve; the connecting rod is a square tube with opened grooves at two end walls; two ends of the connecting rod is sleeved by the square sleeve of each of the gears, and the T-shaped clamp boards are clamped in the opened grooves; the connecting rod is fixed with the square sleeve through a bolt. The invention has the following beneficial effects: the slide rail unit and the slide rail springback mechanism are both installed in the shell unit, and the slide rail springback mechanism is disposed below the internal face of the slide rail unit so that there is no need to reserve an installation space for the slide rail springback mechanism at the inner portion and the rear end portion of the slide rail unit, so as to effectively reduce the space occupancy rate of the entire slide rail system. Meanwhile, a length of the middle rail of the slide rail unit is guaranteed to ensure that the middle rail and the outer rail coincide with each other in length to meet the bearing requirements of the slide rail drawer. In addition, the slide rail springback mechanism installed in the groove of the shell unit to achieve hidden installation, not only ensuring that appearance of the entire slide rail system is simple and beautiful, but also protecting the slide rail springback mechanism, so as to prevent external pollution from affecting reliability of the slide rail springback mechanism.

Element reference: 10—slide rail unit, 11—outer rail, 111—square through hole, 12—midder rail, 13—inner rail, 131—bridge part, 132—positioning hole, 133—positioning hole, 20—slide rail springback mechanism, 21—springback body, 210—L-shaped limit installing part, 211—containing groove, 212—oblique face part, 213—clamping groove, 214—rear frame, 215—front frame, 216—horizontal through slot, 217—horizontal guiding part, 218—convex, 219—positioning groove, 2110—integrated board, 2111—elastic clamp, 22—slider, 221—internal face board, 2211—front oblique edge, 2212—rear horizontal edge, 222—upper convex part, 2221—cutting edge, 2222—rear bottom edge, 223—lower convex part, 2231—top face, 224—toggle groove, 225—positioning convex, 226—concave opening, 227—horizontal guiding groove, 228—T-shaped groove, 229—T-shaped groove, 2210—front oblique face, 23—toggle, 24—damping device, 25—spring, 30—synchronizing mechanism, 31—gear, 311—central shaft, 312—clamping hook, 313—convex point, 314—square sleeve, 315—T-shaped clamp board, 32—rack, 321—square hole, 33—connecting rod, 331—opened groove, 332—bolt, 34—gear holder, 341—semicircular holder, 342—circular convex board, 3421—through hole, 343—central axis hole, 344—elastic hook, 345—semi-cylindrical groove, 346—holder body, 3461—axial through hole, 347—positioning board, 3471—through hole, 3472—positioning flange, 40—shell unit, 41—linear groove, 42—horizontal board, 43—down-facing groove, 44—rear end positioning board, 45—side face positioning board, 46—elastic hook, 47—positioning boss, 48—avoid hole, 51—stainless steel positioning rivet, 52—positioning pole.

DETAILED DESCRIPTION OF THE PREFERRED EMBODIMENT

For understanding, the terms "front" and "rear" in the present invention refer to the "front" in the same direction as the opening direction of the drawer with respect to the the cabinet, and the "rear" in the same direction as the closing direction. The "internal side" means the side facing the side wall of the cabinet, and the "external side" means the side facing the side wall of the drawer.

Figure 1:
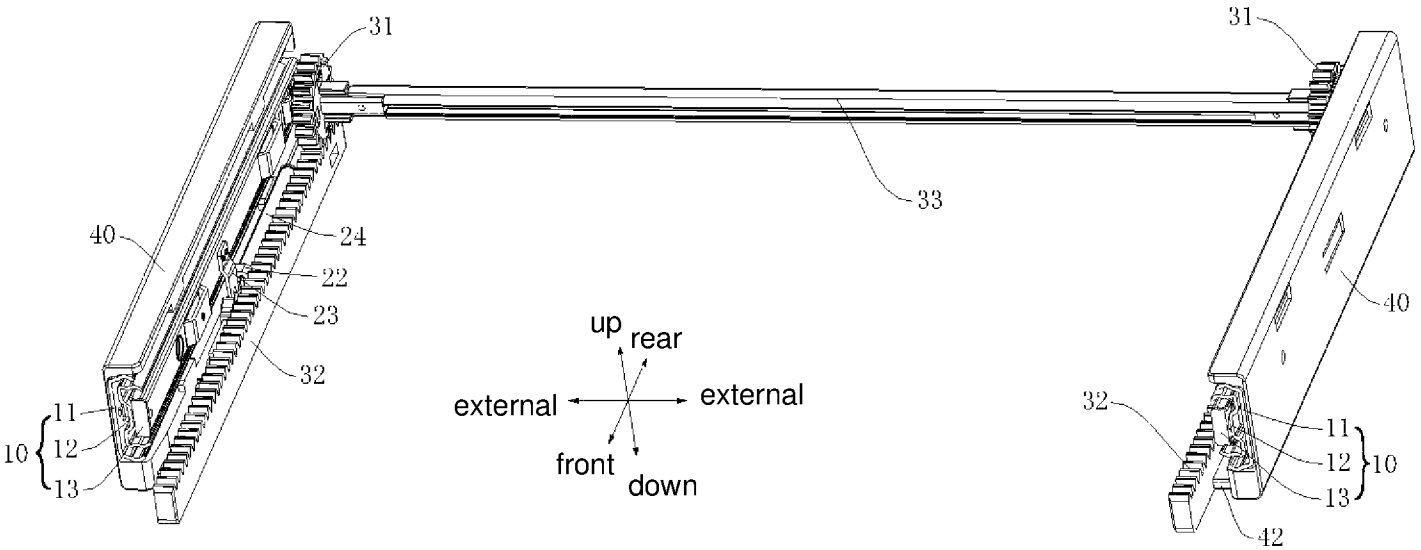
FIG. 1 is a structural view of a synchronic drawer slide rail system under a closed state according to the present invention.
Figure 2:
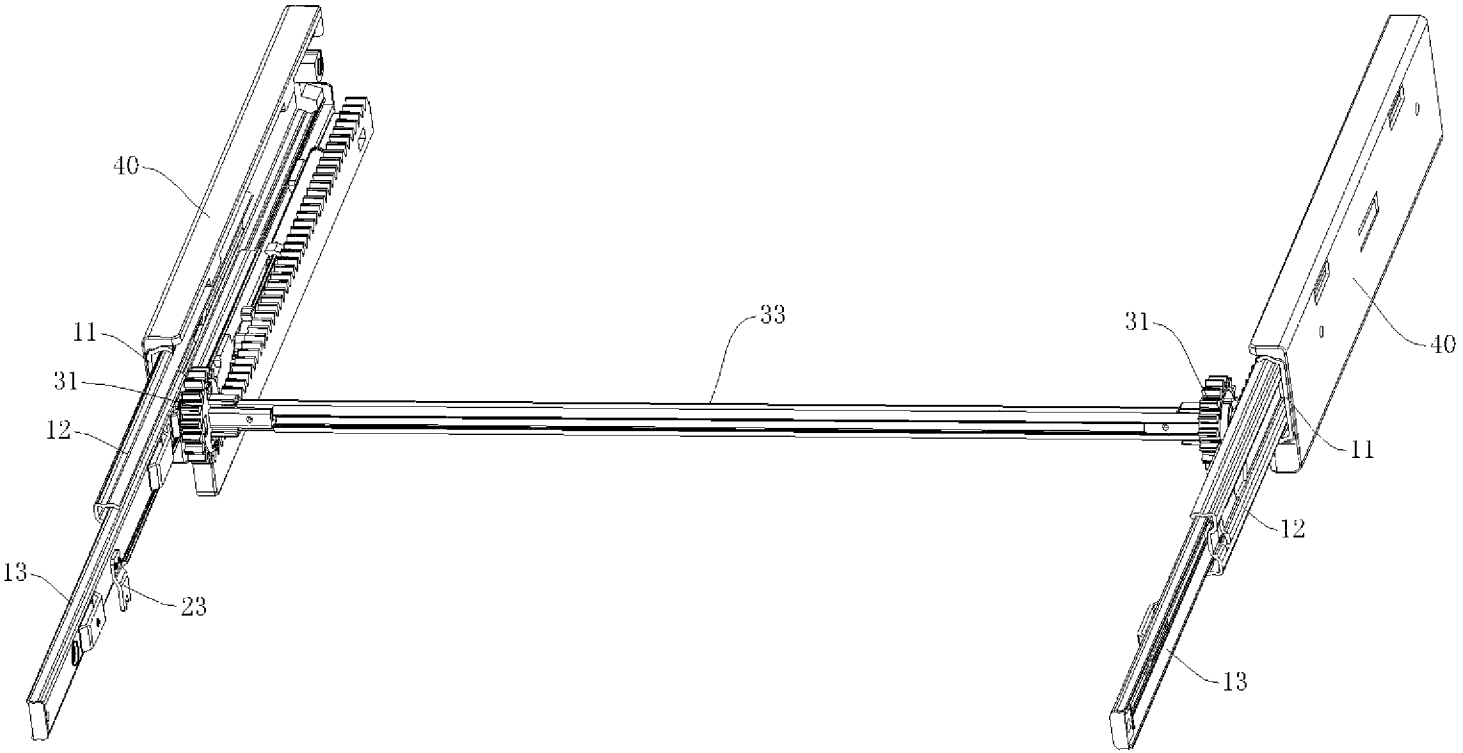
FIG. 2 is a structural view of the synchronic drawer slide rail system under an opened state according to the present invention.
Figure 3:
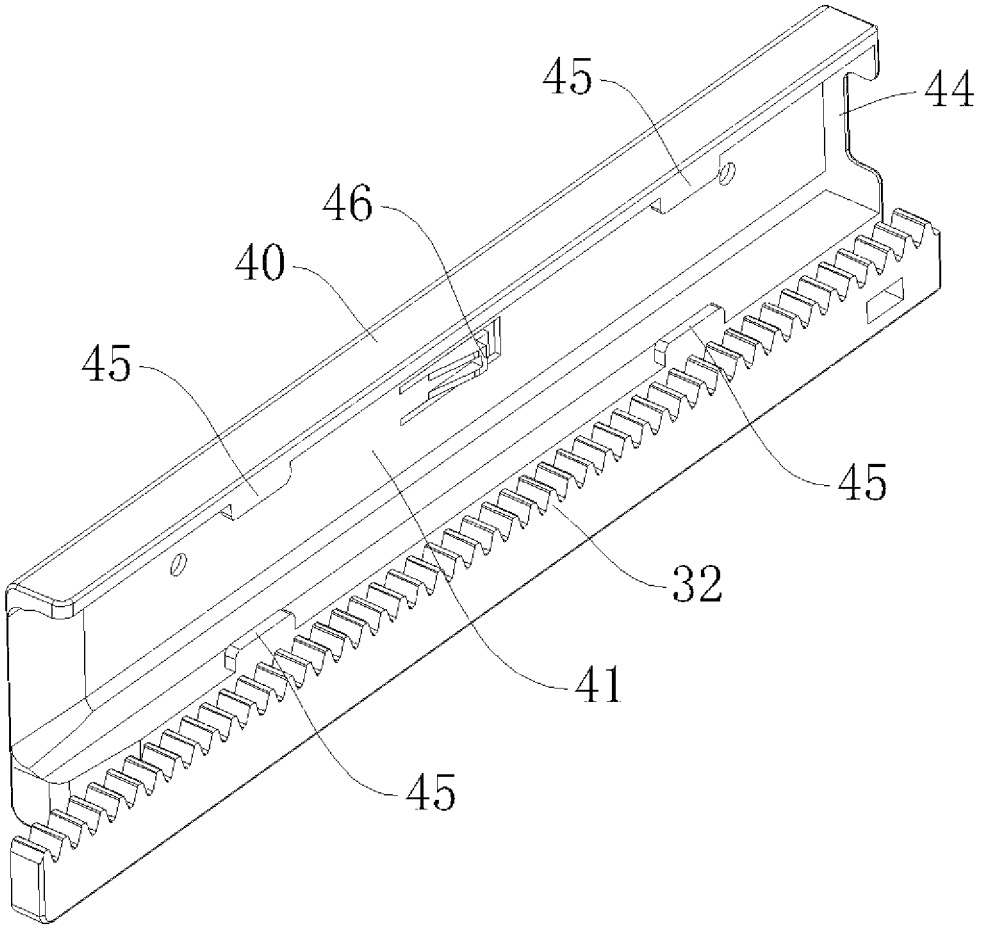
FIG. 3 is a structural view of a shell unit of the synchronic drawer slide rail system according to the present invention.
Figure 4:
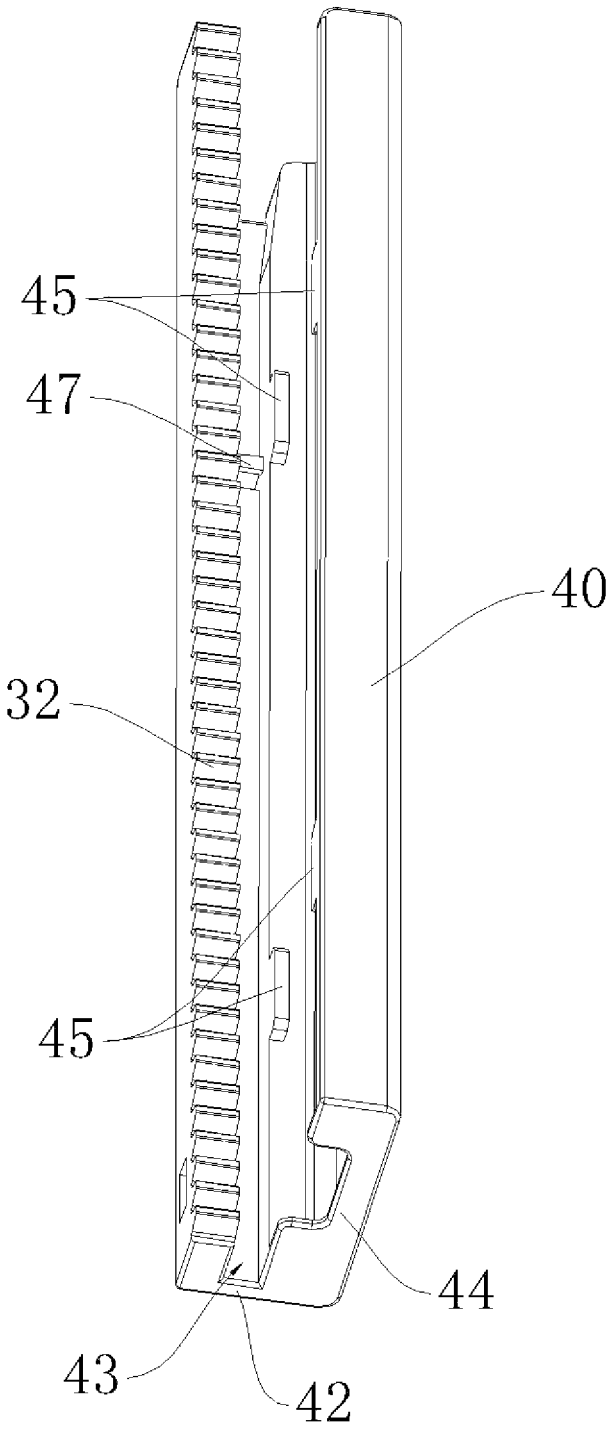
FIG. 4 is another structural view of the shell unit of the synchronic drawer slide rail system according to the present invention.
Figure 5:
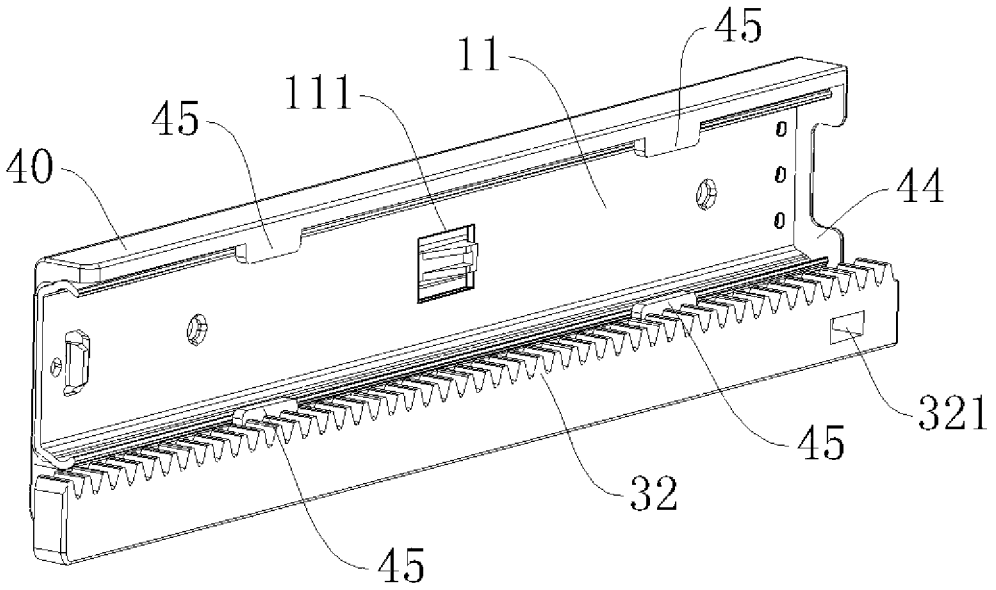
FIG. 5 is a structural view of an outer rail installed inside the shell unit of the synchronic drawer slide rail system according to the present invention.
Figure 24:
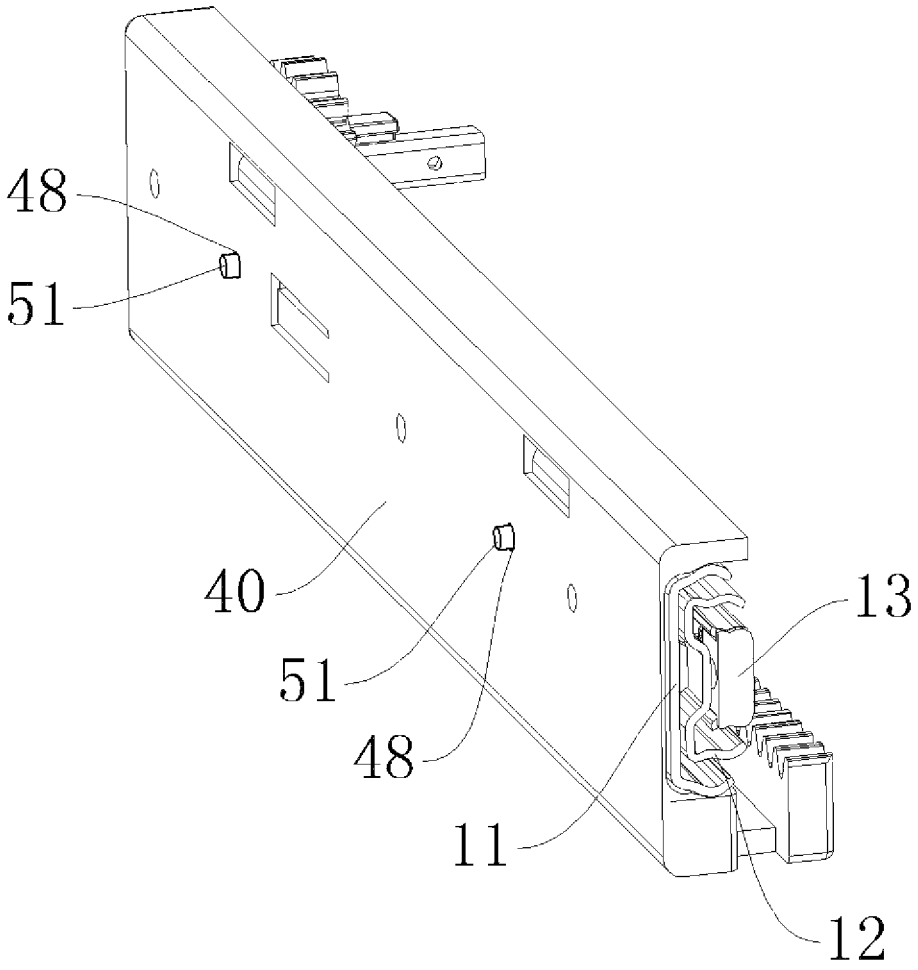
FIG. 24 is a sketch of a positioning structure between an external face of the shell unit and an internal face of a cabinet according to the present invention.
Figure 25:
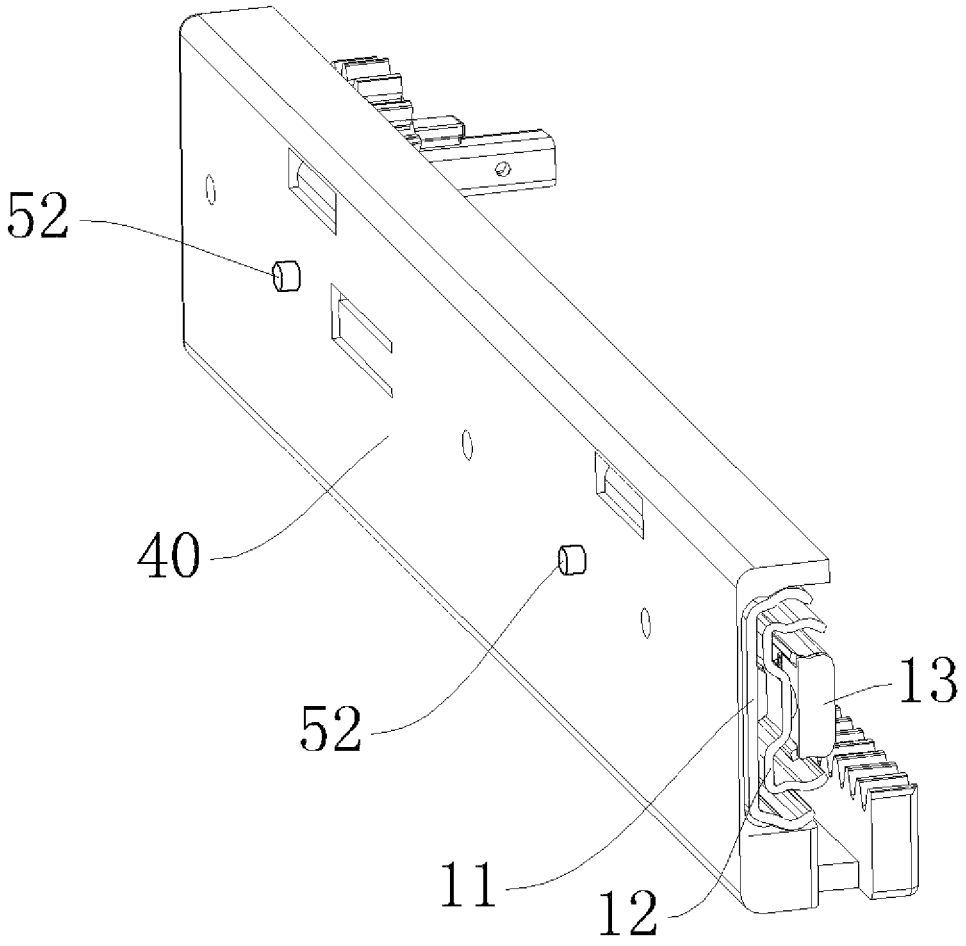
FIG. 25 is a sketch of the positioning structure between the external face of the shell unit and the internal face of the cabinet according to the second embodiment the present invention.

Referring to FIGS. 1 and 2, the present invention provides a synchronic drawer slide rail system with a mute springback function, comprising: two slide rail units 10, wherein two external faces of a drawer are connected to two internal faces of a cabinet in a relative sliding form through the slide rail units 10 which are symmetrically arranged; the two slide rail units 10 are synchronically connected to each other through a synchronizing mechanism 30; wherein each of the slide rail units 10 comprises an outer rail 11, a middle rail 12 and an inner rail 13; the outer rail 11 is connected to the inner rail 13 through the middle rail 12 in a sliding form, and the inner rail 13 is fixed on one of the internal faces of the cabinet; wherein a shell unit 40 is fixed on each of the two internal faces of the cabinet. Referring to FIGS. 3 and 4, a linear groove 41 extending along a relative sliding direction of the drawer and the cabinet is provided on a side face, which faces the drawer, of the shell unit 40; each of the slide rail units 10 is installed in the linear groove 41; a horizontal board 42 extending towards the drawer is arranged at a bottom face of the shell unit 40, and a rack 32 is provided on an inner end of the horizontal board 42; a down-facing groove 43 is formed between a bottom groove wall of the linear groove 41 and the rack 32, and a slide rail springback mechanism 20 is installed in the down-facing groove 43. A positioning boss 47 is provided at a bottom face of the down-facing groove; a rear end positioning board 44 is arranged at a rear end of the linear groove 41 of the shell unit 40, two side face positioning boards 45 are arranged on an upper side groove wall and a lower side groove wall of the down-facing groove 41 respectively and extend oppositely; the outer rail 11 of each of the slide rail units 10 is stuck in the linear groove 41, and the inner rail 13 faces a side face of the drawer; a square through hole 111 is drilled on the outer rail 11; an elastic hook 46 is correspondingly provided at a bottom of the linear groove 41 of the shell unit 40, and the elastic hook 46 is engaged with the square through hole 111; the out rail 11 is limited by the rear end positioning board 44, the side face positioning boards 45 and the elastic hook 46. Referring to FIG. 5, a riveting round hole is drilled on the outer rail 11 of each of the slide rail units 10; an avoid hole 48 is drilled on the shell unit 40 at a position corresponding to the riveting round hole; the outer rail 11 of each of the slide rail units 10 is riveted with the shell unit 40 by a stainless steel positioning rivet 51 passing through the riveting round hole and the avoid hole 48. Referring to FIG. 24 (the outer rail 11 and the riveting round hole thereof are blocked by the shell unit 40 in FIG. 24), the stainless steel positioning rivet 51 extends out of an external face of the shell unit 40 and cooperates with an installing hole on each of the internal faces of the cabinet for positioning, so as to ensure accurate positioning and installation of the slide rail units 10 and the cabinet. Alternatively, referring to FIG. 25, two positioning poles 52 are directly arranged on an external face of the shell unit 40, which cooperates with an installing hole on each of the internal faces of the cabinet for positioning.

Figure 6:
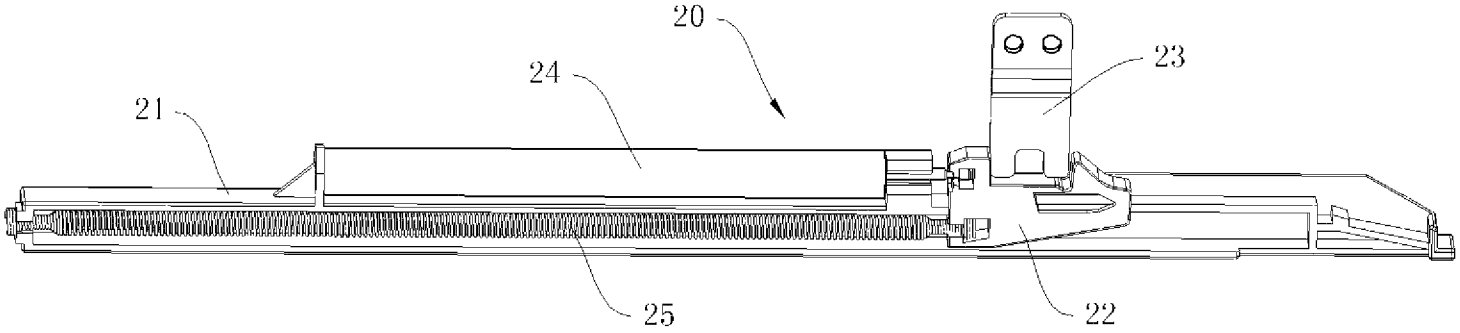
FIG. 6 is a structural view of a slide rail springback mechanism of the synchronic drawer slide rail system according to the present invention.

The slide rail springback mechanism 20 comprises a springback body 21, a slider 22, a toggle 23, a damping device 24 and a spring 25. Referring to FIG. 6, the springback body 21 is mounted on the down-facing groove 43, the toggle 23 is mounted on an internal wall of the inner rail 13, and a guiding structure is provided on the springback body 21; the damping device 24 and a rear end of the spring 25 are mounted on the springback body 21, and the damping device 24 is parallel to the spring 25; a front end of a damping rod of the damping device 24 and a front end of the spring 25 are respectively connected to the slider 22; the slider 22 is installed on and movable along the guiding structure; the toggle 23 cooperates with the slider 22 to move the slider 22 along the guiding structure.

Figure 7:
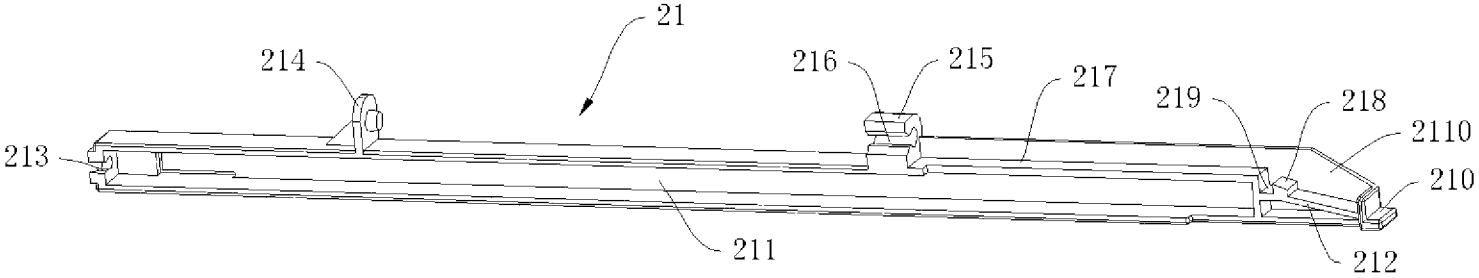
FIG. 7 is a structural view of a springback body of the slide rail springback mechanism.
Figure 10:
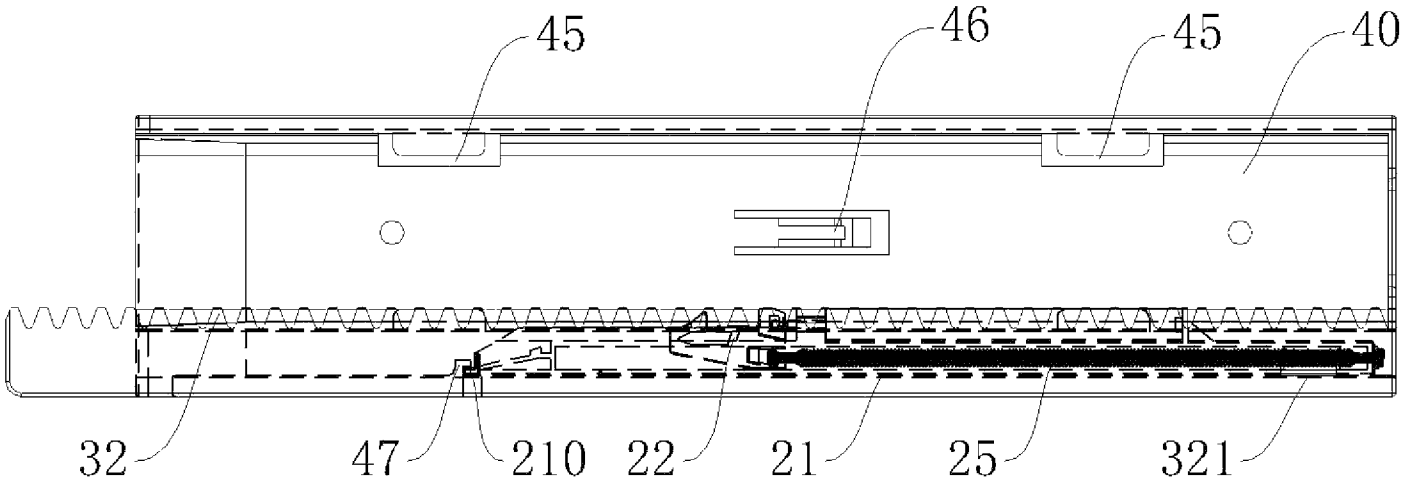
FIG. 10 illustrates installation of the slide rail springback mechanism and the shell unit of the synchronic drawer slide rail system according to the present invention.
Figure 11:
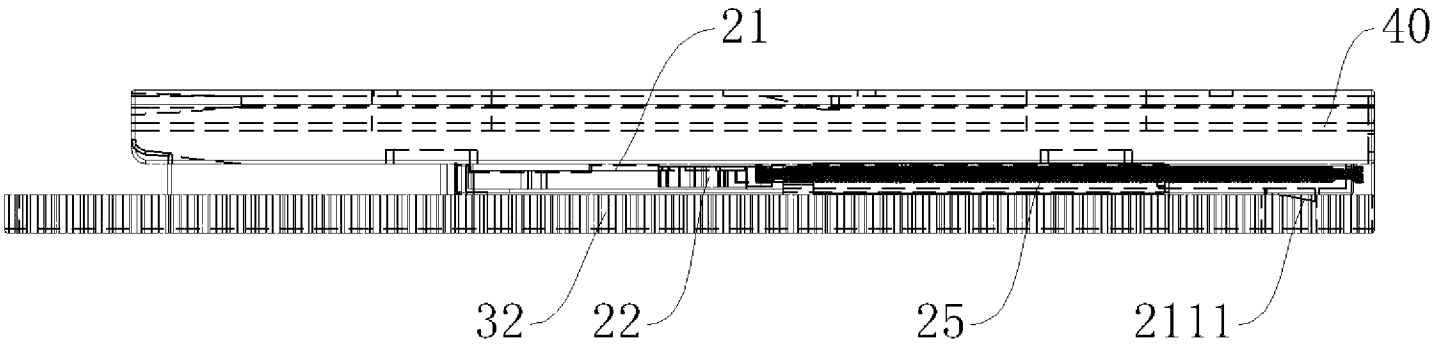
FIG. 11 is a top view of FIG. 10.

Referring to FIG. 7, the springback body 21 is hollowed along a length direction to form a containing groove 211 with an opened external side and form an oblique face part 212; a front end of the containing groove 211 is sealed, and a rear end of the containing groove 211 has a clamping groove 213; the spring 25 is placed in the containing groove 211, and the rear end of the spring 25 is clamped in the clamping groove 211; a damping device fixing structure is provided on a top wall of the containing groove 211. The damping device fixing structure comprises a rear frame 214 and a front frame 215; a rear end of the damping device 24 is mounted on the rear frame 214, and a front end of the damping device 24 is limited by the front frame 215; a horizontal through slot 216 is drilled on the front frame 215, and the guiding rod of the damping device 24 is connected to a rear end of the slider 22 by passing through the horizontal through slot 216. A portion of the top wall of the containing groove 211, which is in front of the damping device fixing structure, forms a horizontal guiding part 217; the slider 22 is placed on the horizontal guiding part 217; a rear top portion of the slider 22 is fixed with the guiding rod of the damping device 24, and a rear bottom portion of the slider 22 is fixed with the front end of the spring 25; the oblique face part 212 extending downwards is integrally provided in front of the containing groove 211; a convex 218 is provided on the oblique face part 212, which forms a positioning groove 219 with a front top corner of the containing groove 211; an L-shaped limit installing part 210 is provided at a front end of the oblique face part 212, which cooperates with the positioning boss 47 at a groove bottom of the shell unit 40 as shown in FIG. 10; the horizontal guiding part 217, the oblique face part 218, the positioning groove 219 and the L-shaped limit installing part 210 form the guiding structure; a square hole 321 is drilled at a front bottom of the rack 32, and an elastic clamp 2111 is provided at a rear end of the springback body 21; when the springback body 21 is installed in the down-facing groove 43, the elastic clamp 2111 is clamped with the square hole 321 as shown in FIG. 11.

Figure 8:
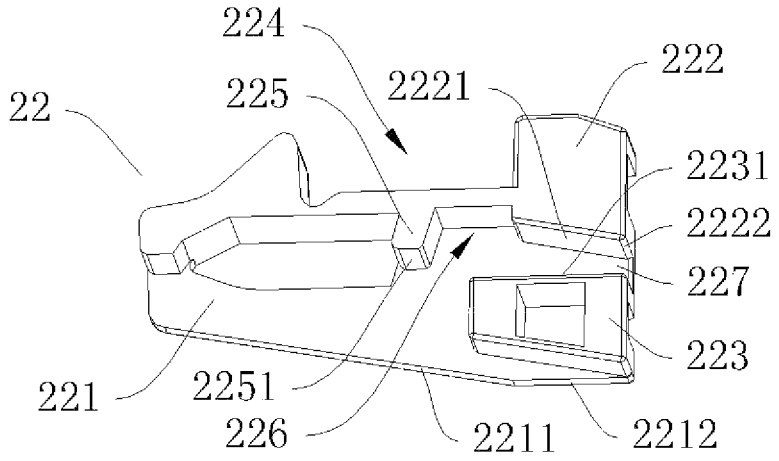
FIG. 8 is an enlarged view of a slider of the slide rail springback mechanism.
Figure 9:
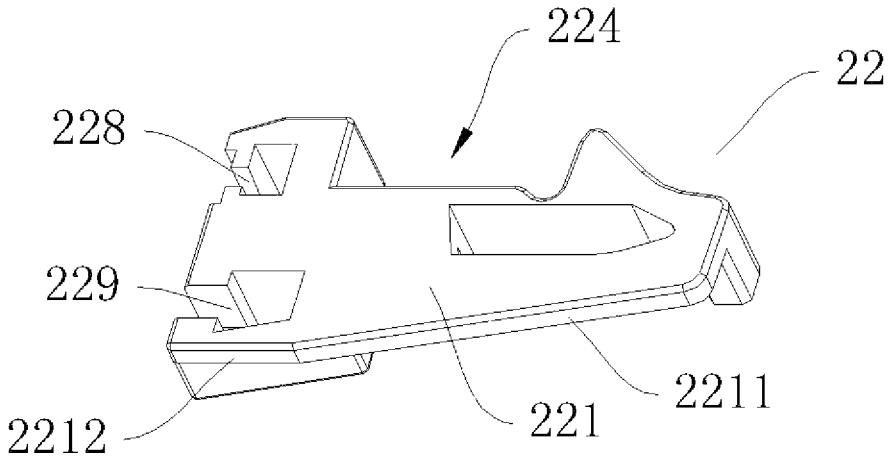
FIG. 9 is another enlarged view of the slider of the slide rail springback mechanism.

Referring to FIGS. 8 and 9, the slider 22 comprises an internal face board 221; an upper convex part 222 and a lower convex part 223 are provided on an external side of the internal face board 221; the lower convex part 223 is placed at a bottom rear end of the internal face board 221, and a top face 2231 of the lower convex part 223 is a horizontal face; a toggle groove 224 with an up-facing opening is provided at a top portion of the upper convex part 222; a cutting edge 2221, which is obliquely upward, is provided on a bottom face of the upper convex part 222 directly facing the lower convex part 223; a positioning convex 225 facing downwards is provided on a bottom face of the upper convex part 222; a concave opening 226 with upward concave is formed between the cutting edge 2221 and the positioning convex 225; a bottom face of the positioning convex 225 is aligned with a rear bottom edge 2222 of the upper convex part 222; a horizontal guiding groove 227 is formed by the positioning convex 225 of the upper convex 222, the rear bottom edge 2222 and the top face 2231 of the lower convex part 223; the horizontal guiding part 217 of the springback body 21 is embedded in the horizontal guiding groove 227; a bottom edge of the internal face board 221 comprises a front oblique edge 2211 and a rear horizontal edge 2212 connected with each other; the front oblique edge 2211 is obliquely upward and forward, and is parallel to the cutting edge 2221; the positioning convex 225 and the front oblique edge 2211 respectively cooperate with the positioning groove 219 and the oblique face part 212 of the springback body 21. T-shaped grooves 228, 229 are provided on the upper convex part 222 and a rear end of the lower convex part 223; a front end of the guiding rod of the damping device 24 is embedded in the T-shaped groove 228 of the upper convex part 222, and the front end of the spring 25 is embedded in the T-shaped groove 229 of the lower convex part 223. An integrated board 2110 is provided at the horizontal guiding part 217 and an external face of the oblique face part 218 of the springback body 21, so as to limit the external side of the slider 22, and prevent the slider from externally tipping when being moved by the toggle 23.

Referring to FIGS. 1 and 2, the synchronizing mechanism 30 comprises two gears 31, the rack 32 on each of the slide rail units 10 and a connecting rod 33; the two gears 31 are respectively installed on the inner rail 13 of corresponding slide rail units 10 by gear holders 34; the rack 32 on the shell unit 40 of each of the slide rail units 10 is respectively engaged with one of the gears 31, and the two gears 31 are synchronically connected by the connecting rod 33. During opening or closing the drawer, the connecting rod 33 moves the gears 31 along the racks 32 at both sides, so as to synchronically open or close the slide rail units 10 at both sides.

Figure 12:
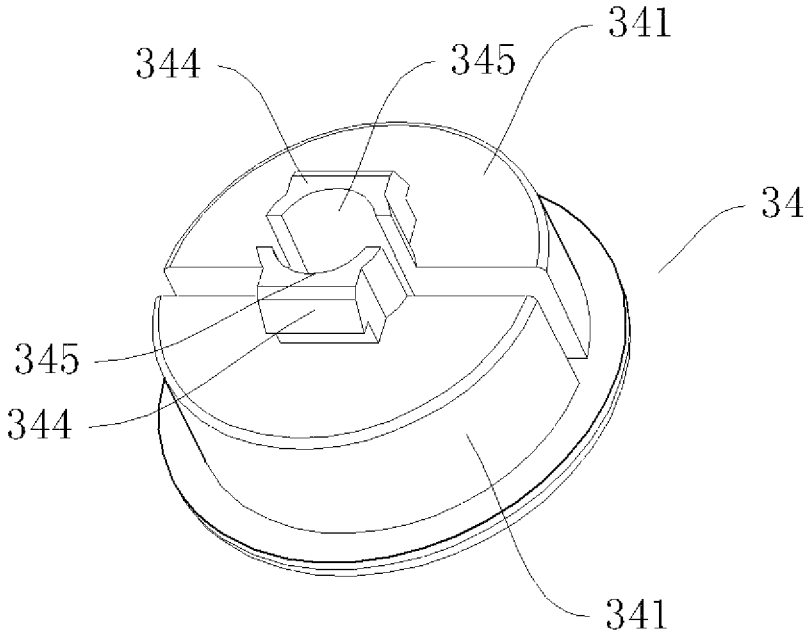
FIG. 12 is a sketch view of an external face of a gear holder in a synchronizing mechanism.
Figure 13:
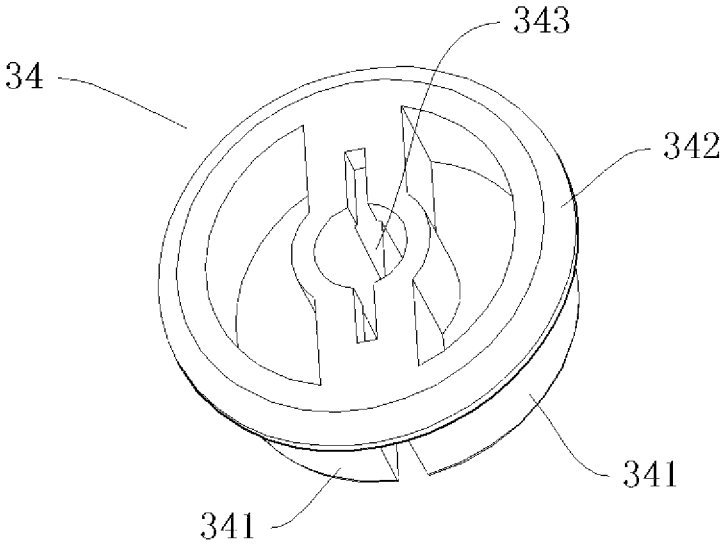
FIG. 13 is a sketch view of an internal face of the gear holder in the synchronizing mechanism.
Figure 14:
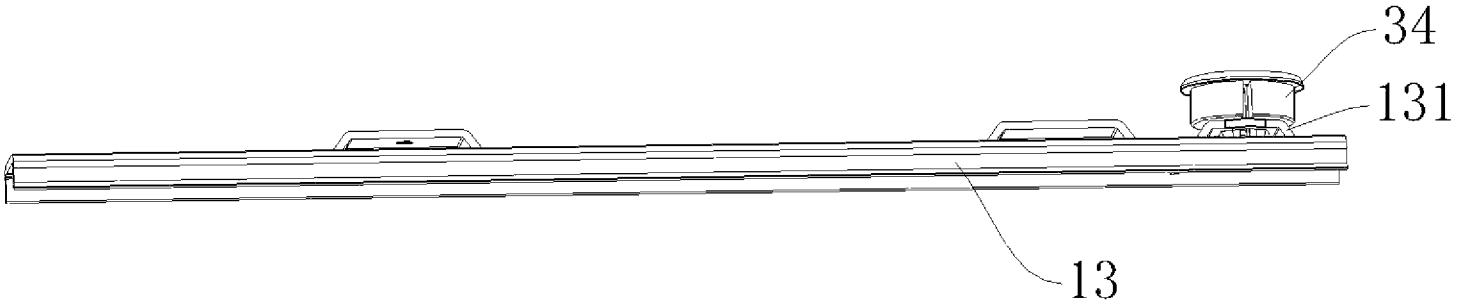
FIG. 14 illustrates installation of the gear holder of the synchronizing mechanism and an inner rail of a slide rail unit.

Referring to FIGS. 12-14, each of the gear holders 34 comprises two semicircular holders 341 oppositely arranged; internal sides of the two semicircular holders 341 are fixed with a circular convex board 342 having a central axis hole 343; two elastic hooks 344 are symmetrically arranged on internal faces of the semicircular holders 341, which have symmetric semi-cylindrical grooves 345; a bridge part 131 extending inwards is provided on the internal wall of the inner rail 13 of each of the slide rail units 10, and an installing hole is drilled on the bridge part 131; the two elastic hooks 344 of the gear holders 34 are engaged with the installing hole.

Figure 15:
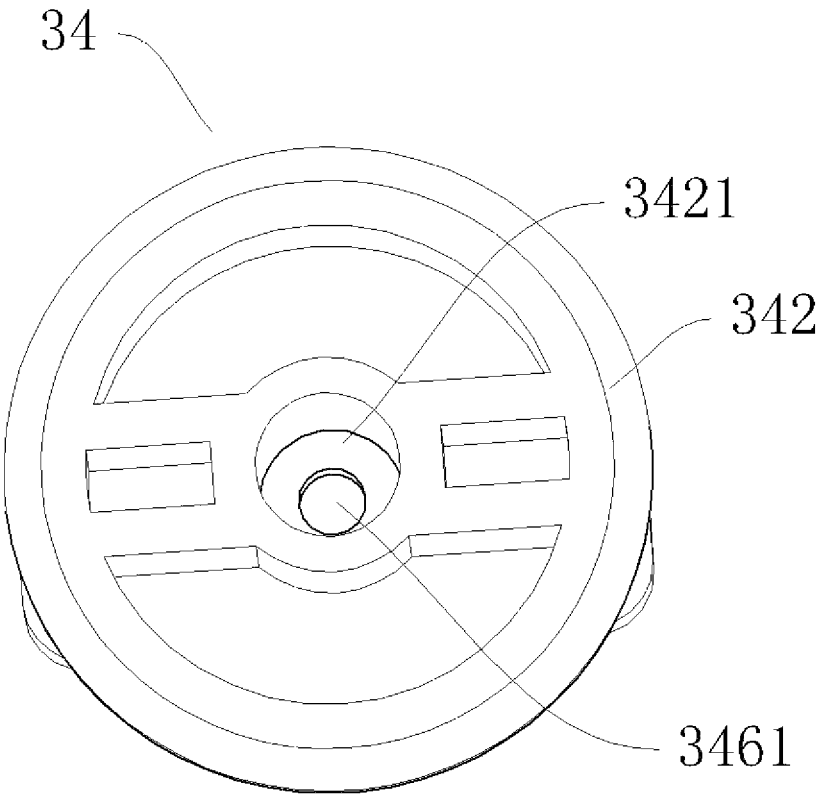
FIG. 15 is a sketch view of the external face of the gear holder in the synchronizing mechanism according to a second embodiment.
Figure 16:
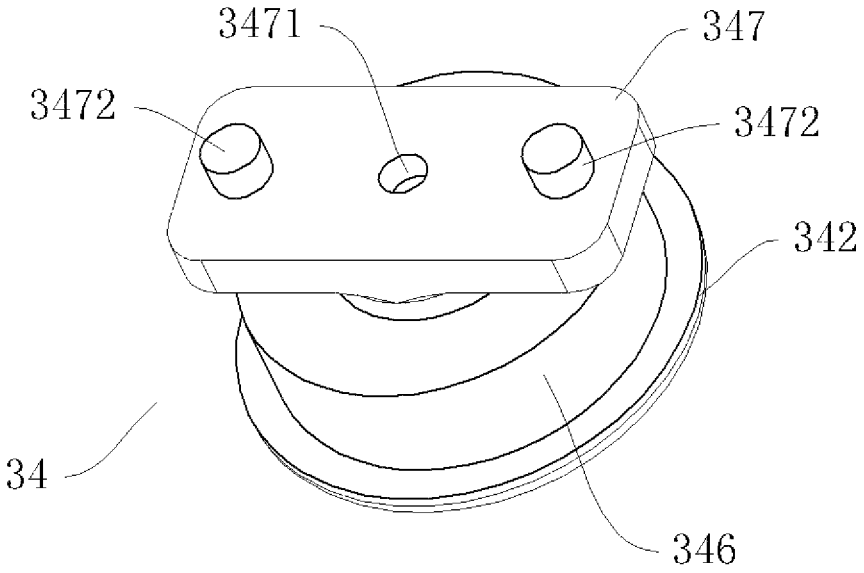
FIG. 16 is a sketch view of the internal face of the gear holder in the synchronizing mechanism according to the second embodiment.
Figure 17:
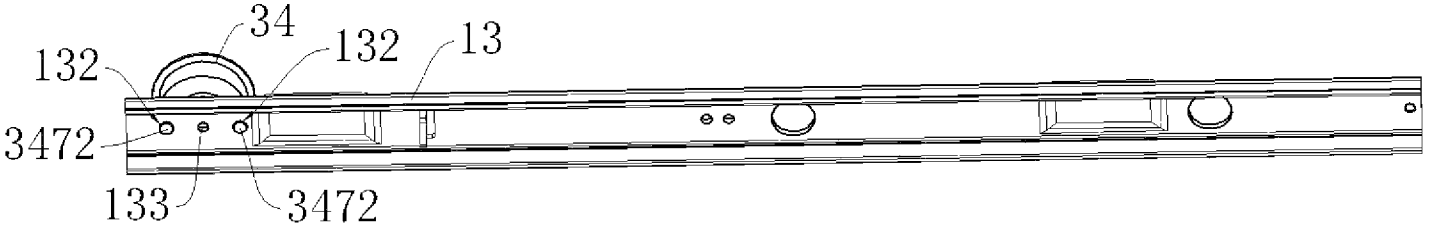
FIG. 17 illustrates installation of the gear holder of the synchronizing mechanism and the inner rail of the slide rail unit according to the second embodiment.
Figure 18:
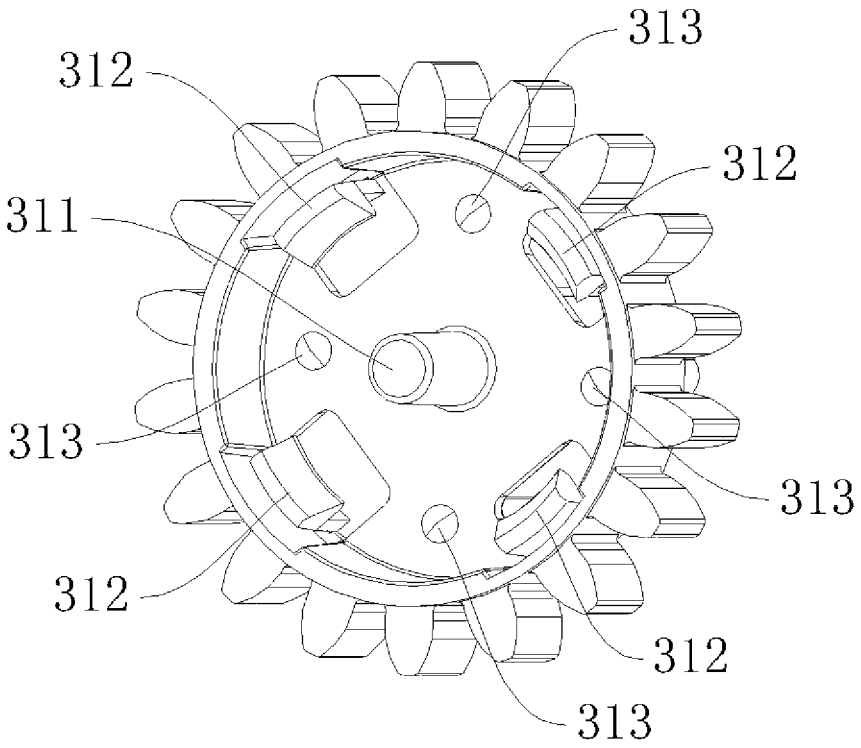
FIG. 18 is a sketch view of an external face of a gear in the synchronizing mechanism.

Alternatively, referring to FIGS. 15-17, each of the gear holders 34 comprises a holder body 346 having an axial through hole 3461; a circular convex board 342 extending out of a circumference of the holder body 346 is placed on an internal face of the holder body 346, and a positioning board 347 is mounted on an external face of the holder body 346; through holes 3421, 3471 communicating with the axial through hole 3461 is drilled at centers of the circular convex board 342 and the positioning board 347 respectively; a positioning flange 3472 is provided at two sides of the through hole 3421 on an external face of the positioning board 347 respectively; positioning holes 132, 133 are drilled on the inner rail 13 of each of the slide rail units 10 corresponding to the positioning flange 3472 and the through hole 3471; the positioning flange 3472 is embedded in the positioning hole 132 of the inner rail 13, and a rivet passes through the through hole 3421 of the circular convex board 342, the axial through hole 3461 of the holder body 346, the through hole 3471 of the positioning board 347 and a middle positioning hole 133 of the inner rail 13 in sequence, so as to rivet the gear holders 34 with the inner rail 13 of each of the slide rail units.

An external side of each of the gears 31 has a concave chamber; a central shaft 311 is provided at a bottom center of the concave chamber; clamping hooks 312 are evenly arranged around the central shaft 311; a convex point 313 is provided at a bottom face of the concave chamber between adjacent clamping hooks 312; the circular convex board 342 of each of the gear holders 34 extends into the concave chamber of each of the gears 31 while the central shaft 311 extends into the central axis hole 343, and the clamping hooks 312 are engaged with a circumference of the circular convex board 342. Meanwhile, the convex point 313 contacts with internal end faces of the gear holders 34, so as to reduce a friction when the gears 31 rotate.

A square sleeve 314 is provided at an internal face center of each of the gears 31; T-shaped clamp boards 315 are symmetrically arranged at two sides of the square sleeve 314; the connecting rod 33 is a square tube with opened grooves 331 at two end walls; two ends of the connecting rod 33 is sleeved by the square sleeve 314 of each of the gears 31, and the T-shaped clamp boards 314 are clamped in the opened grooves 331; the connecting rod 33 is fixed with the square sleeve 314 through a bolt 332.

Figure 19:
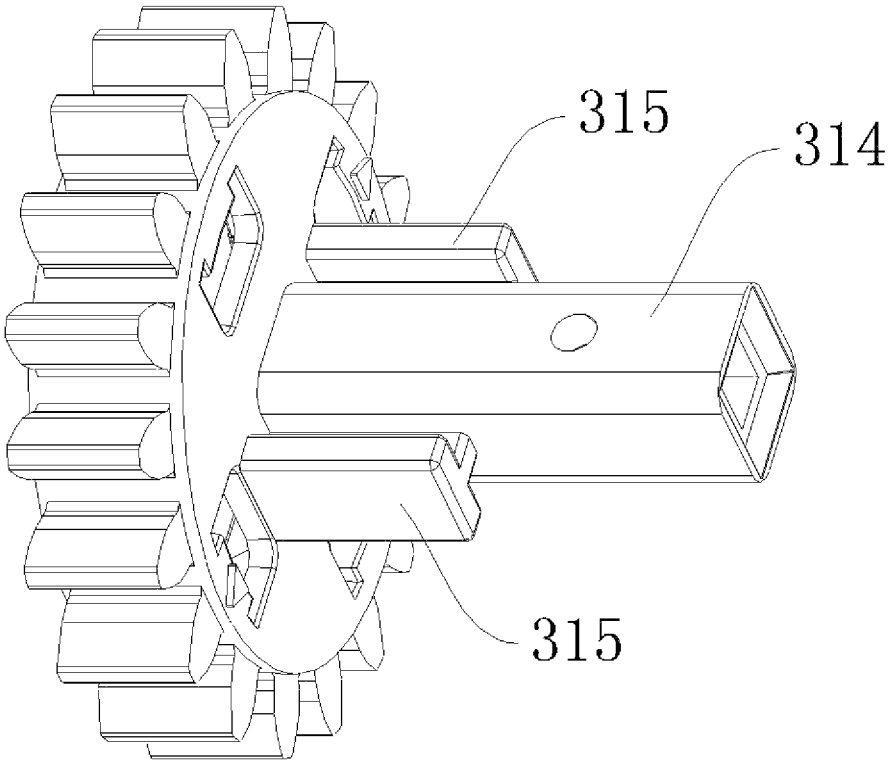
FIG. 19 is a sketch view of an internal face of the gear in the synchronizing mechanism.

Referring to the drawings, working processes of the synchronic drawer slide rail system of the present invention are illustrated as follows. After closing the drawer, the inner rail 13, the middle rail 12 and the outer rail 11 are completely closed. The gears 31 of two synchronizing mechanisms 30 are at rear end portions of the racks 32. The toggle 23 installed on the internal face of the inner rail 13 is clamped in the toggle groove 224 of the slider 22, while the guiding rod of the damping device 24 and the spring 25 are completed shrank, as shown in FIG. 19*a*. When pulling the drawer forwards, the inner rail 13 of the drawer moves forwards, in such a manner that the toggle 23 moves the slider 22 forwards along the horizontal guiding part 217 of the springback body 21 while the guiding rod of the damping device 24 and the spring 25 are extended, as shown in FIG. 19*b*. When the positioning convex 225 of the slider 22 keeps moving forwards after reaching a front corner of the horizontal guiding part 217, the positioning convex 225 slides into the positioning groove 219 of the springback body 21 while an overall oblique of the slider 22 is limited by the oblique face part 212. Meanwhile, the toggle groove 224 at the top of the slider 22 is synchronically lower in the front and lower in the rear. The toggle 23 is detached from the front groove wall of the toggle groove 224 as the inner rail keeps moving forwards. When the drawer further pulls the inner rail 13 to open, the slider 22 cooperates with the positioning groove 219 through the positioning convex, and is positioned at the front end of the springback body 21 in an oblique forwards form, wherein the spring 25 and the guiding rod of the damping device 24 are completely extended, as shown in FIG. 19*c*. For closing the drawer, the drawer moves the inner rail 13 backwards. Since the slider 22 is still oblique forwards, namely the toggle groove 224 is still lower in the front and higher in the rear, the toggle 23 is driven by the inner rail 13 to pass through the front groove wall of the toggle groove 224 and enter the toggle groove 224 while the rear end face of the toggle 23 contacts with the rear groove wall of the toggle groove 224. When the inner rail 13 keeps moving the toggle 23 backwards, the toggle 23 slightly pushes the slider 22 in a counterclockwise direction and the positioning convex 225 is detached from the positioning groove 219, wherein the whole slider 22 returns to a horizontal state from the oblique forwards state, and the toggle groove 224 of the slider 22 is also horizontal. Front and rear ends of the toggle 23 is completely limited by the toggle groove 224, and the guiding rod of the damping device 24 slowly moves the slider 22 backwards under a springback effect of the spring 25. Meanwhile, the slider 22 drives the toggle 23 and the inner rail 13 to slower move backwards together until the inner rail 13 is complete closed, which means the drawer is completely closed.

Figure 20:
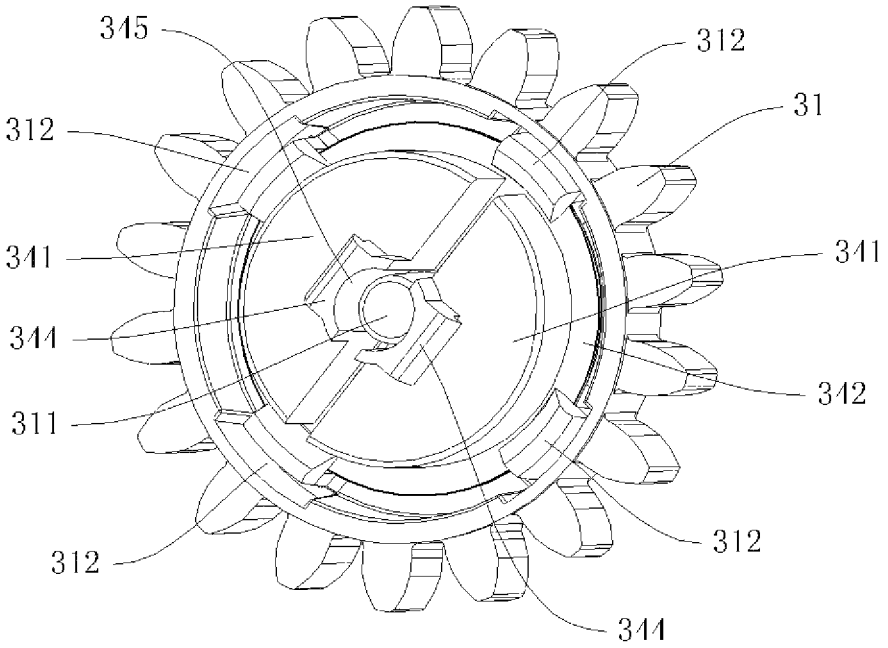
FIG. 20 illustrates installation of the gear and the gear holder of the synchronizing mechanism.
Figure 21:
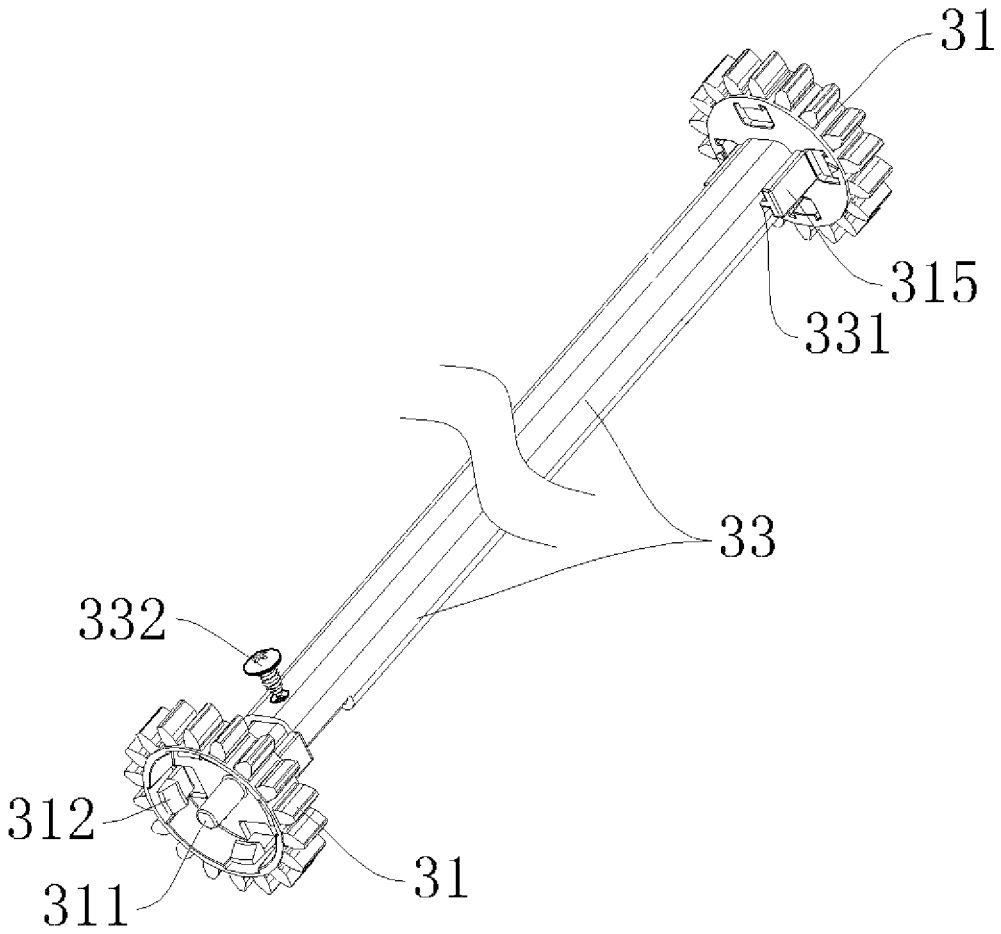
FIG. 21 is an enlarged view of an end portion of a connected rod of the synchronizing mechanism assembled with the gear.
Figure 22:
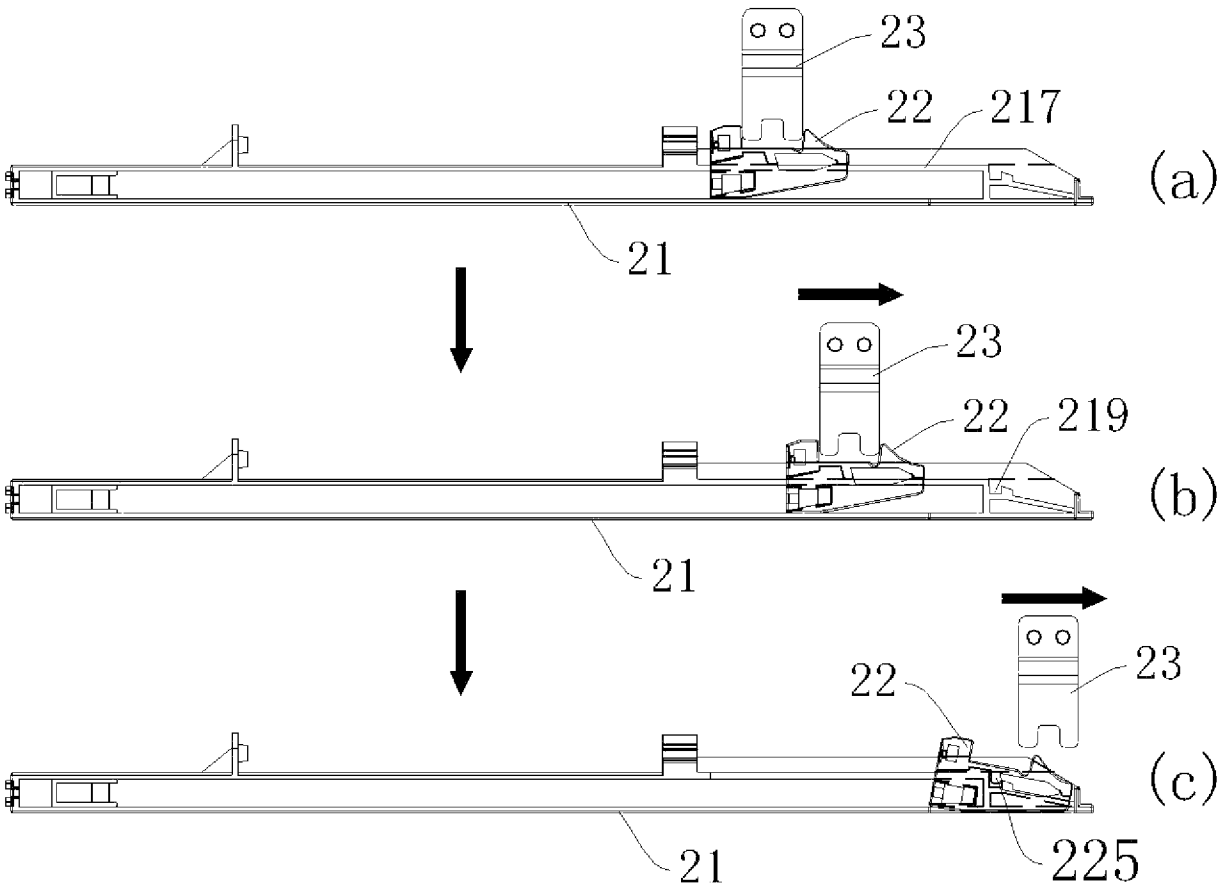
FIG. 22 illustrates the slider of the slide rail springback mechanism moving on the springback body.
Figure 23:
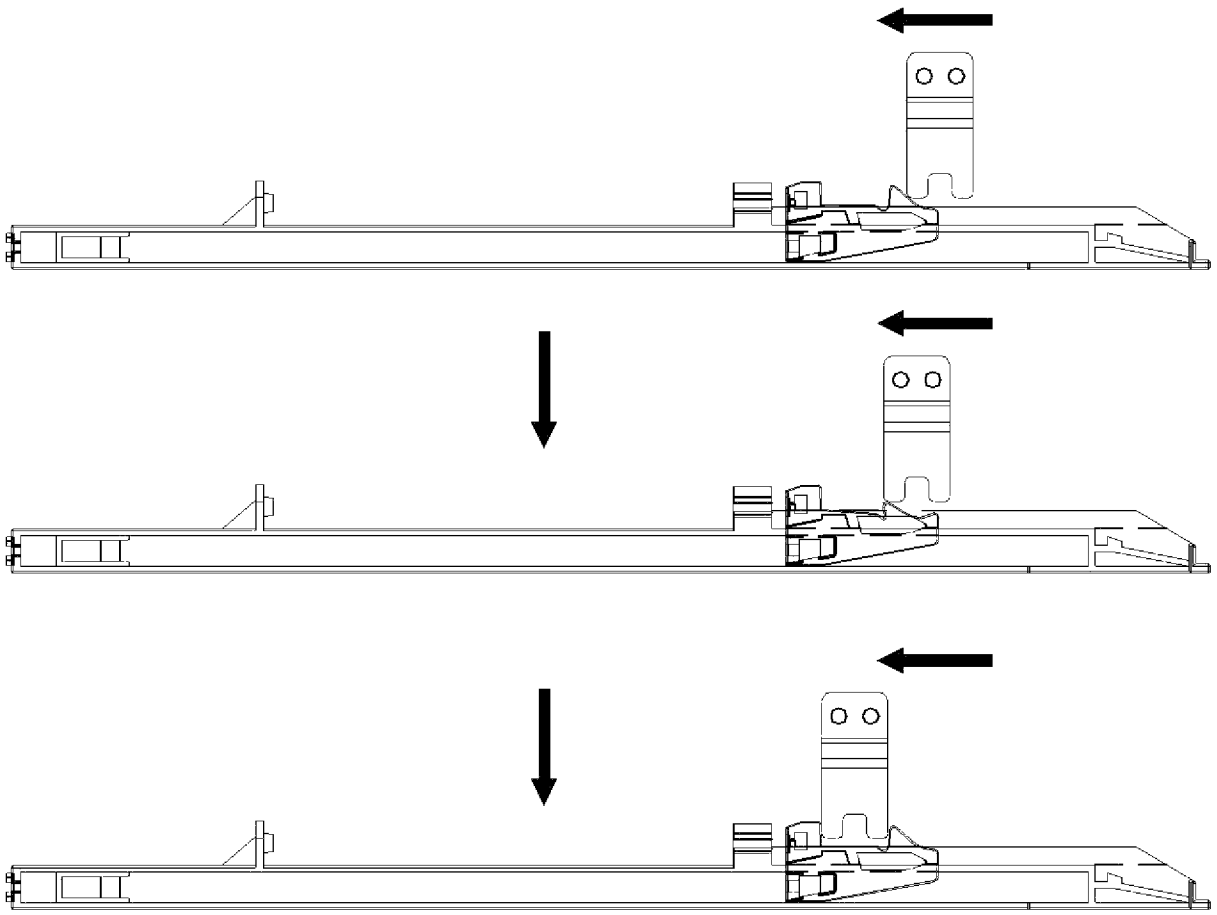
FIG. 23 illustrates automatic return when a toggle in the slide rail springback mechanism fails to cooperate with the slider.

When the drawer is complete opened, the slider 22 may automatically get rid of the positioning groove 219 under the springback effect of the spring 25 when the cabinet is affected by external vibration, resulting in failure of the whole slide rail springback mechanism. Referring to FIG. 20, at this moment, the drawer should be pushed backwards so that the drawer moves the inner rail 13 backwards until the rear bottom of the toggle 23 presses against the front oblique face 2210 of the slider 22, then keeping pushing the drawer backwards can move the toggle 23 upwards along the front oblique face 2210 of the slider 22. Because the slider 22 is made of elastic plastic, the front groove wall of the toggle groove 224 of the slider 22 is squeezed downwards by the toggle 23 to form a downward plastic deformation, in such a manner that the bottom of the toggle 23 pass through the front groove wall of the toggle groove 224 and recovers with deformation of the front groove wall of the toggle groove 224. As a result, the whole toggle 23 enters and is limited by the toggle groove 224, which recovers functions of the slide rail springback mechanism 20.

What is claimed is:

1. A synchronic drawer slide rail system with a mute springback function, comprising: two slide rail units, wherein two external faces of a drawer are connected to two internal faces of a cabinet in a relative sliding form through the slide rail units which are symmetrically arranged; the two slide rail units are synchronically connected to each other through a synchronizing mechanism; wherein each of the slide rail units comprises an outer rail, a middle rail and an inner rail; the outer rail is connected to the inner rail through the middle rail in a sliding form, and the inner rail is fixed on one of exterior faces of the drawer; wherein a shell unit is fixed on each of the two internal faces of the cabinet; a linear groove extending along a relative sliding direction of the drawer and the cabinet is provided on a side face, which faces the drawer, of the shell unit; each of the slide rail units is installed in the linear groove; a horizontal board extending towards the drawer is arranged at a bottom face of the shell unit, and a rack is provided on an inner end of the horizontal board; a down-facing groove is formed between a bottom groove wall of the linear groove and the rack, and a slide rail springback mechanism is installed in the down-facing groove;

wherein a rear end positioning board is arranged at a rear end of the linear groove of the shell unit, two side face positioning boards are arranged on an upper side groove wall and a lower side groove wall of the down-facing groove respectively and extend oppositely; the outer rail of each of the slide rail units is stuck in the linear groove, and the inner rail faces a side face of the drawer; a square through hole is drilled on the outer rail; an elastic hook is correspondingly provided at a bottom of the linear groove of the shell unit, and the elastic hook is engaged with the square through hole; the outer rail is limited by the rear end positioning board, the side face positioning boards and the elastic hook;

wherein a riveting round hole is drilled on the outer rail of each of the slide rail units; an avoid hole is drilled on the shell unit at a position corresponding to the riveting round hole; the outer rail of each of the slide rail units is riveted with the shell unit by a stainless steel positioning rivet passing through the riveting round hole and the avoid hole; the stainless steel positioning rivet extends out of an external face of the shell unit and cooperates with an installing hole on each of the internal faces of the cabinet for positioning;

wherein the slide rail springback mechanism comprises a springback body, a slider, a toggle, a damping device and a spring; the springback body is mounted on the down-facing groove, the toggle is mounted on an internal wall of the inner rail, and a guiding structure is provided on the springback body; the damping device and a rear end of the spring are mounted on the springback body, and the damping device is parallel to the spring; a front end of a damping rod of the damping device and a front end of the spring are respectively connected to the slider; the slider is installed on and movable along the guiding structure; the toggle cooperates with the slider to move the slider along the guiding structure.

2. The synchronic drawer slide rail system, as recited in claim 1, wherein the springback body is hollowed along a length direction to form a containing groove with an opened external side and form an oblique face part; a front end of the containing groove is sealed, and a rear end of the containing groove has a clamping groove; the spring is placed in the containing groove, and the rear end of the spring is clamped in the clamping groove; a damping device fixing structure is provided on a top wall of the containing groove; a portion of the top wall of the containing groove, which is in front of the damping device fixing structure, forms a horizontal guiding part; the slider is placed on the horizontal guiding part; a rear top portion of the slider is fixed with the guiding rod of the damping device, and a rear bottom portion of the slider is fixed with the front end of the spring; the oblique face part extending downwards is integrally provided in front of the containing groove; a convex is provided on the oblique face part, which forms a positioning groove with a front top corner of the containing groove; an L-shaped limit installing part is provided at a front end of the oblique face part; the horizontal guiding part, the oblique face part, the positioning groove and the L-shaped limit installing part form the guiding structure; an integrated board is provided at the horizontal guiding part and an external face of the oblique face part of the springback body.

3. The synchronic drawer slide rail system, as recited in claim 2, wherein the slider comprises an internal face board; an upper convex part and a lower convex part are provided on an external side of the internal face board; the lower convex part is placed at a bottom rear end of the internal face board, and a top face of the lower convex part is a horizontal face; a toggle groove with an up-facing opening is provided at a top portion of the upper convex part; a cutting edge, which is obliquely upward, is provided on a bottom face of the upper convex part directly facing the lower convex part; a positioning convex facing downwards is provided on a bottom face of the upper convex part; a concave opening with upward concave is formed between the cutting edge and the positioning convex; a bottom face of the positioning convex is aligned with a rear bottom edge of the upper convex part; a horizontal guiding groove is formed by the positioning convex of the upper convex, the rear bottom edge and the top face of the lower convex part; the horizontal guiding part of the springback body is embedded in the horizontal guiding groove; a bottom edge of the internal face board comprises a front oblique edge and a rear horizontal edge connected with each other; the front oblique edge is obliquely upward and forward, and is parallel to the cutting edge; the positioning convex and the front oblique edge respectively cooperate with the positioning groove and the oblique face part of the springback body.

4. The synchronic drawer slide rail system, as recited in claim 3, wherein a T-shaped groove is provided on the upper convex part and a rear end of the lower convex part; a front end of the guiding rod of the damping device is embedded in the T-shaped groove of the upper convex part, and the front end of the spring is embedded in the T-shaped groove of the lower convex part.

5. The synchronic drawer slide rail system, as recited in claim 2, wherein the damping device fixing structure comprises a rear frame and a front frame; a rear end of the damping device is mounted on the rear frame, and a front end of the damping device is limited by the front frame; a horizontal through slot is drilled on the front frame, and the guiding rod of the damping device is connected to a rear end of the slider by passing through the horizontal through slot.

6. The synchronic drawer slide rail system, as recited in claim 1, wherein the synchronizing mechanism comprises two gears, the rack on each of the slide rail units and a connecting rod; the two gears are respectively installed on the inner rail of corresponding slide rail units by gear holders; the rack on the shell unit of each of the slide rail units is respectively engaged with one of the gears, and the two gears are synchronically connected by the connecting rod.

7. The synchronic drawer slide rail system, as recited in claim 6, wherein each of the gear holders comprises two semicircular holders oppositely arranged; internal sides of the two semicircular holders are fixed with a circular convex board having a central axis hole; two elastic hooks are symmetrically arranged on internal faces of the semicircular holders, which have symmetric semi-cylindrical grooves; a bridge part extending inwards is provided on the internal wall of the inner rail of each of the slide rail units, and an installing hole is drilled on the bridge part; the two elastic hooks of the gear holders are engaged with the installing hole.

8. The synchronic drawer slide rail system, as recited in claim 7, wherein an external side of each of the gears has a concave chamber; a central shaft is provided at a bottom center of the concave chamber; clamping hooks are evenly arranged around the central shaft; a convex point is provided at a bottom face of the concave chamber between adjacent clamping hooks; the circular convex board of each of the gear holders extends into the concave chamber of each of the gears while the central shaft extends into the central axis hole, and the clamping hooks are engaged with a circumference of the circular convex board.

9. The synchronic drawer slide rail system, as recited in claim 8, wherein a square sleeve is provided at an internal face center of each of the gears; T-shaped clamp boards are symmetrically arranged at two sides of the square sleeve; the connecting rod is a square tube with opened grooves at two end walls; two ends of the connecting rod is sleeved by the square sleeve of each of the gears, and the T-shaped clamp boards are clamped in the opened grooves; the connecting rod is fixed with the square sleeve through a bolt.

10. The synchronic drawer slide rail system, as recited in claim 6, wherein each of the gear holders comprises a holder body having an axial through hole; a circular convex board extending out of a circumference of the holder body is placed on an internal face of the holder body, and a positioning board is mounted on an external face of the holder body; a through hole communicating with the axial through hole is drilled at centers of the circular convex board and the positioning board respectively; a positioning edge is provided at two sides of the through hole on an external face of the positioning board respectively; a positioning flange is drilled on the inner rail of each of the slide rail units corresponding to the positioning flange and the through hole; the positioning flange is embedded in the positioning hole of the inner rail, and a rivet passes through the through hole of the circular convex board, the axial through hole of the holder body, the through hole of the positioning board and a middle positioning hole of the inner rail in sequence, so as to rivet the gear holders with the inner rail of each of the slide rail units.

11. The synchronic drawer slide rail system, as recited in claim 10, wherein an external side of each of the gears has a concave chamber; a central shaft is provided at a bottom center of the concave chamber; clamping hooks are evenly arranged around the central shaft; a convex point is provided at a bottom face of the concave chamber between adjacent clamping hooks; the circular convex board of each of the gear holders extends into the concave chamber of each of the gears while the central shaft extends into the central axis hole, and the clamping hooks are engaged with a circumference of the circular convex board.

12. The synchronic drawer slide rail system, as recited in claim 11, wherein a square sleeve is provided at an internal face center of each of the gears; T-shaped clamp boards are symmetrically arranged at two sides of the square sleeve; the connecting rod is a square tube with opened grooves at two end walls; two ends of the connecting rod is sleeved by the square sleeve of each of the gears, and the T-shaped clamp boards are clamped in the opened grooves; the connecting rod is fixed with the square sleeve through a bolt.

* * * * *